United States Patent [19]

Frelund

[11] 4,408,722

[45] Oct. 11, 1983

[54] FUEL INJECTION NOZZLE WITH GROOVED POPPET VALVE

[75] Inventor: Arthur R. Frelund, Okemos, Mich.

[73] Assignee: General Motors Corporation, Detroit, Mich.

[21] Appl. No.: 268,366

[22] Filed: May 29, 1981

[51] Int. Cl.[3] ..... B05B 1/32

[52] U.S. Cl. ..... 239/453; 239/533.12

[58] Field of Search ..... 239/452, 453, 456, 459, 239/560, 564, 584, 112, 533.2–533.12

[56] References Cited

U.S. PATENT DOCUMENTS

| | | | |
|---|---|---|---|
| 2,172,556 | 9/1939 | Edwards | 239/452 |
| 2,263,197 | 11/1941 | Tabb et al. | 239/453 |
| 2,708,601 | 5/1955 | Links | 239/452 |
| 2,719,055 | 9/1955 | Lauck . | |
| 2,878,064 | 3/1959 | Nicolls et al. . | |

*Primary Examiner*—John J. Love
*Assistant Examiner*—Paul A. Sobel
*Attorney, Agent, or Firm*—Arthur N. Krein

[57] ABSTRACT

A fuel injection nozzle of the outward opening poppet valve type includes a closure member reciprocable in the axial bore of a spray tip so as to control fuel flow therefrom and to form therewith an annular discharge spray orifice. The closure member includes a valve head with a pintle extending therefrom, the pintle having an annular groove therein that is located relative to the free end of the pintle so that during opening movement of the closure member this groove will not extend outward from the spray tip. The groove as thus located is operative to effect turbulent flow of the fuel being discharged and to act as a thermal barrier and is thus operative to substantially eliminate carbon build-up in the injection nozzle.

2 Claims, 3 Drawing Figures

FUEL INJECTION NOZZLE WITH GROOVED POPPET VALVE

FIELD OF THE INVENTION

This invention relates to liquid fuel injection nozzles for internal combustion engines and, in particular, to such injection nozzles of the outward opening poppet valve type for use in diesel engines.

DESCRIPTION OF THE PRIOR ART

Fuel injection nozzles of the outward opening, poppet valve type for use in diesel engines are well known. In this type of injection nozzle, there is provided a closure member, in the form of a poppet valve, that is movable to an open position relative to an associate valve seat by the pressure of fuel, as supplied periodically by a high pressure pump, and that is movable to its closed position in seating engagement with the valve seat by a spring acting on a collar positioned so as to loosely encircle the stem of the closure member whereby it can abut against an enlarged head at the inner end of the stem of the closure member.

In a particular form of such a fuel injection nozzle as presently used in diesel engines for passenger vehicles and, as disclosed, for example, in U.S. Pat. No. 2,878,064, entitled Liquid Fuel Injection Nozzles for Internal Combustion Engines, issued Mar. 17, 1959 to W. E. W. Nicolls and Peter Howes, the poppet head of the closure member is recessed in the spray tip of the nozzle assembly whereby, upon opening of the closure member relative to its associated valve seat, these elements define a spray discharge orifice of annulus configuration.

In this type injection nozzle, the poppet head of the closure member is provided with a pintle portion which is arranged in the bore of the spray tip whereby upon initial opening of the closure member pilot flow of atomized fuel particles is initiated. Thereafter, upon full opening of the closure member, fuel will be discharged via the spray discharge orifice in a spray pattern of annulus configuration so as to effect relative deep penetration of the fuel spray into the associate combustion chamber.

The desirability of providing fuel injection nozzles of the above type which will retain the above described fuel spray characteristics when subjected to heat and carbon during use in a diesel engine has long been recognized. As known in the art, carbon deposits on such injection nozzles can affect both the quantity of fuel and the spray pattern of the fuel being ejected therefrom.

It has been recognized that on these fuel injection nozzles the carbon will deposit thereon both as a result of the combustion products generated in the combustion chamber and, as a result of heating of these nozzles and the fuel therein due to high combustion temperatures within the combustion chamber. Actually, it is believed that heat is the prime cause of carbon build-up in such fuel injection nozzles. This is probably due to the fact that fuel trapped between the outside peripheral surface of the closure member and the inner peripheral discharge orifice wall of the spray tip will coke up as a result of the high temperatures generated by the combustion of fuel within the combustion chamber.

SUMMARY OF THE INVENTION

It is therefor, a primary object of the present invention to provide an improved fuel injection nozzle for use in diesel engines that is operable in a manner whereby to substantially eliminate carbon buildup on the cooperating spray discharge elements thereof without affecting the spray pattern of the fuel being discharged therefrom.

Accordingly, another object of the invention is to provide an improved fuel injection nozzle of the outward opening, poppet valve type wherein the head of the poppet valve has an annular groove therein located so as to provide a thermal boundry and so as to effect turbulent fuel flow during the discharge of fuel whereby to substantially eliminate carbon build-up inside the injection nozzle, the groove being located so as to have negligible effect on static flow of the injector or on the fuel spray pattern discharged therefrom.

A further object of the invention is to provide an improved fuel injection nozzle so constructed whereby it will remain substantially free of carbon build-up during extended operation thereof in a diesel engine.

For a better understanding of the invention, as well as other objects and further features thereof reference is had to the following detailed description of the invention to be read in connection with the accompanying drawings.

Figure 1:
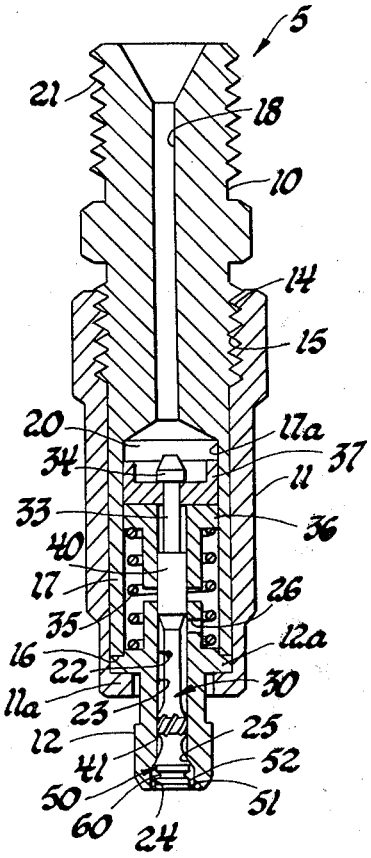
FIG. 1 is an enlarged longitudinal, cross-sectional view of a fuel injection nozzle constructed in accordance with the invention, showing the closure member thereof in elevation.

Referring now first to FIG. 1, there is illustrated a preferred embodiment of an outward opening, poppet type fuel injection nozzle, generally designated 5, constructed in accordance with the invention. The fuel injection nozzle 5 is of a type that is adapted to be mounted, for example, in the cylinder head of a diesel engine with the spray tip end thereof suitably located so as to discharge fuel into an associated combustion chamber of the engine.

The fuel injection nozzle 5, in the construction illustrated is provided with a multipiece nozzle housing that includes a tube-like fitting 10, a tubular body 11 and a spray tip 12 suitably secured together in a conventional manner. Thus in the construction illustrated, the fitting 10 is secured to the body 11 by threaded engagement of the external threads 14 thereof with the internal threads 15 at the upper end of the body 11, with reference to FIG. 1, whereby the radial flange 12*a* of the spray tip 12 is sandwiched between the lower face 16 of the tubular portion 17 of fitting 10 and the internal shoulder 11*a* of body 11.

As shown, the fitting 10 is provided with an axial stepped bore therethrough to define a passage 18 that extends downward from the upper or free end of the fitting so as to open at its other end into a cylindrical fuel chamber 20 defined in part by the circular internal wall 17*a* of the lower tubular portion 17 of this fitting. In addition, fitting 10 at its upper end is provided with suitable external threads 21 whereby a fuel supply tube and associate tube coupling, both not shown, can be secured thereto so that the injection nozzle 5 can be intermittently supplied with fuel, for example, as by a high pressure distribution pump, not shown, in a conventional manner.

Spray tip 12 is provided with an axial stepped bore 22 therethrough so as to define a straight, circular internal upper bore wall 23 and a straight, circular internal lower bore wall 24 of an inside diameter greater than the inside diameter of wall 23, the bore wall 24 in effect defining a spray discharge passage for the delivery of fuel from the injection nozzle. Bore walls 23 and 24 are interconnected by an inclined shoulder defining a conical shaped, annular valve seat 25. Spray tip 12 is also provided with at least one radial port 26 located so as to communicate with the passage defined by bore wall 23 at a predetermined axial location upstream of valve seat 25, for a purpose to be described hereinafter.

Discharge of fuel from the spray discharge passage 24 is controlled by means of a closure member 30, in the form of a poppet type valve, that is axially reciprocable in the bore 22 of the spray tip 12 in a manner to be described in detail hereinafter.

In the construction illustrated, the closure member 30 includes a poppet type valve head, generally designated 31, having an annular valve surface 32 at one end thereof, formed complementary to the valve seat 25 for seating engagement therewith, and a valve stem 33 that extends upward from this valve head 31, with reference to FIG. 1, to terminate at an enlarged stem head 34.

The closure member 30 is normally biased in an axial direction whereby its valve surface 32 seats against the valve seat 25 by means of a coil spring 35. In the construction illustrated, one end of the coil spring 35 abuts against a portion of the radial flange **12*a* of the spray tip 12 while its opposite end abuts against a spring retainer sleeve 36. The spring retainer sleeve 36 is in turn, adapted to abut a washer-like valve retainer collar 37 suitably secured to the stem head 34**.

As is well known, the internal bore wall **17*a* of the fitting 10 is preselected so as to loosely receive the spring retainer sleeve 36 and the valve retainer collar 37. The outside peripheral dimensions of both of the last two elements 36 and 37 are appropriately sized relative to the inside diameter of the bore wall 17*a*** whereby to provide a suitable annular clearance therebetween for the axial flow of fuel, as is conventional in this type of injection nozzle.

The stem 33 of the closure member 30 is provided with axially spaced apart upper and lower lands 40 and 41, respectively, of preselected outside diameters so as to be slidably received by the bore wall 23 with the lower land 41 being provided with circumferentially spaced apart, axially extending grooves 42 therein. As shown, the lands 40 and 41 are suitably spaced apart and the radial port 26 is axially located relative to these lands so that fuel can be supplied to the passage defined by the bore wall 23 during normal axial movement of the closure member 30 between closed and open positions relative to the valve seat 25.

Figure 2:
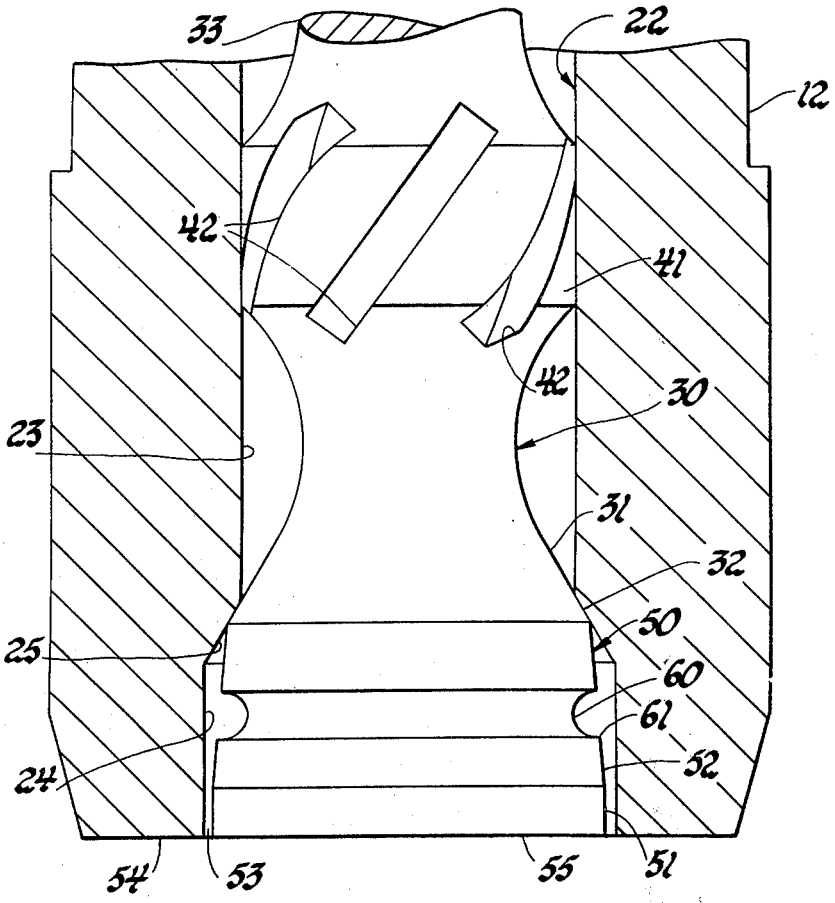
FIG. 2 is a further enlarged cross-sectional view of the spray discharge portion of the injection nozzle of FIG. 1, with the closure member thereof shown seated against its associate valve seat in the spray tip; and, FIG. 3 is a further enlarged cross-sectional view, similar to that of FIG. 2, of the spray discharge portion of the injection nozzle of FIG. 1, but with the closure member shown in its full opened position relative to its associate valve seat.
Figure 3:
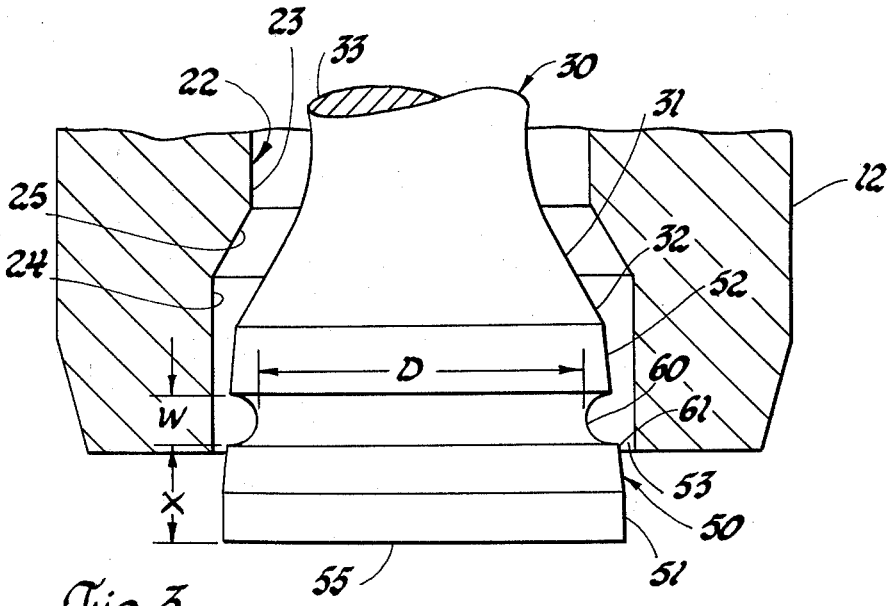

The closure member 30, in the construction illustrated, includes a spray control pintle 50 that is formed integral with the valve head 31 so as to project downwardly, with reference to the Figures, relative to the valve surface 32. As best seen in FIGS. 2 and 3, the spray control pintle 50 is formed with a narrow cylindrical pintle land 51, of a predetermined full pintle diameter, at its free or outer end, and with a control cone 52 tapering inwardly therefrom. The control cone 52, for example, in a particular embodiment is inclined at an angle of approximately 5° from the pintle land 51.

As best seen in FIGS. 2 and 3, the valve head 31 with its spray control pintle 50 portion is slidably received in the bore wall 24 defining the discharge passage and coacts therewith to define an annular spray discharge orifice 53 next adjacent to the spray tip end 54 of spray tip 12 whereby fuel will be discharged in an annular spray pattern.

Preferably, and as best seen in FIG. 2, the axial extent of the pintle 50 is preselected relative to the axial extent of the bore wall 24 in the spray tip 12 so that, when the closure member 30 is in its retracted position, the position shown in FIGS. 1 and 2, with the valve surface 31 thereof seated against valve seat 25, the pintle land 51 will be substantially fully retracted into the spray discharge passage defined by the bore wall 24. Thus in this retracted position of the closure member 30, the lower end surface 55 of the pintle is substantially flush with the spray tip end surface 54 of spray tip 12.

In addition, the axial extent of the pintle land 51 and the cone angle and axial extent of the control cone 52 are preselected relative to the maximum axial length of travel of the closure member 30 in its movement from the closed position, shown in FIG. 2, to its fully open position, shown in FIG. 3, relative to valve seat 25, so as to obtain a desired annular spray pattern for a particular engine-combustion chamber application.

Thus in the embodiment shown, during opening movement of the closure member 30 relative to valve seat 25, a variable size flow orifice will be provided as defined by these elements. During this opening movement of the closure member 30, the pintle 50 will first define with the lower internal wall 24 a uniform and then a variable size spray discharge orifice, as defined by the lower internal wall 24 and first by the straight pintle land 51 and then by the control cone 52.

Thus, for example, in an embodiment of the injection nozzle for use in a particular engine-combustion application the extent of travel of the closure member 30 relative to its associate valve seat 24 is approximately 0.030 inch (0.762 mm). In this embodiment, the internal diameter of the lower bore wall 24 in the spray tip 12 was 0.146 to 0.148 inch (3.712 to 3.764 mm), the external diameter of the mated pintle land 51 was 0.1456 to 0.1472 inch (3.70 to 3.74 mm) and its axial extent was 0.0181 to 0.016 inch (0.46 to 0.41 mm) and the angle of the control cone 52 converging therefrom was 5° 15′ to 5° 0′.

In the above-described embodiment of the injection nozzle 5, the force of the spring 35 was selected so that the closure member 30 would open when this assembly was supplied with fuel at approximately 1225 psi (8446.08 kPa) supply pressure and, the closing pressure of this injection nozzle was approximately 800 psi (5515.8 kPa.). The above pressures relate to static operating conditions of the injection nozzle, and do not reflect the fuel pressures that would be required to open or close the closure member when the injection nozzle is operatively associated with the combustion chamber of a diesel engine during its operation.

Now in accordance with the invention, the valve head 31 of the closure member 30 is provided with an annular groove 60 formed in the peripheral surface of the control cone 52 portion of pintle 50 thereof. As best seen in FIGS. 2 and 3, the groove 60 is of a predetermined width W and diameter D to be described hereinafter. The groove 60 is located on the control cone 52 so that its downstream edge 61, in terms of fuel flow, is a preselected distance X from the free end surface 55 of the pintle 50 portion of the valve head 31 so that this groove and, in particular, the downstream edge 61 thereof will not project out beyond the spray tip end surface 54 of the spray tip 12 upon full opening movement of the closure member 30. These dimensions W, D and X are preselected for a given injection nozzle 5 as used in a particular engine application, as described hereinafter, with the dimension X always being selected so as to be greater than the extent of travel of closure member 30 for the reasons given hereinafter.

In accordance with a feature of the invention, the groove 60 is provided in the peripheral surface of pintle cone 52 so as to function both as a thermal barrier, during engine operation, and so as to cause turbulent flow of fuel during injection. By proper sizing and location of the groove 60, these functions can both occur without substantially affecting the predetermined, desired annular spray pattern of the fuel being discharged from the injection nozzle 5 for a given engine application.

For this purpose, the groove 60 is preferably formed as narrow and as deep as possible and is axially located relative to the lower end surface 55 of the closure member 30 so that it will stay within the spray tip 12 during full opening movement of the closure member 30. In addition, the width dimension W is made as small as practical so as to maintain the sac-volume of the injector nozzle as small as possible. However, in practice, due to the relatively small size of such an injector as used in vehicle engines, and due to the material of the closure member and to the method of fabrication of the closure member 30, the width W and the diameter D of the groove 60 may be compromised from their preferred relative dimensions, as necessary, in a particular injection nozzle assembly so as to facilitate high volume production of these injection nozzles.

For the purpose of preventing the injection of fuel in a secondary spray pattern during fuel discharge, the downstream edge 61 of groove 60, as described hereinabove, is located a suitable distance X from the free end surface 55 of the closure member as a function of the lift of travel of the closure member 30 relative to the valve seat 25 so that, during full opening movement of the closure member 30, the downstream edge 61 will not project below the end surface 54 of the spray tip 12.

Thus as used in the particular embodiment of the injection nozzle 5 structure defined hereinabove, the width W was 0.015 to 0.021 inch (0.3810 to 0.5334 mm) the diameter D was 0.122 inch (3.0988 mm) and distance X was 0.033 inch (0.8382 mm). Thus it will be apparent that in this exemplary embodiment because of the axial extent of the pintle 50, the lower width dimension 0.015 inch (0.3810 mm) of the groove 60 was selected as the lower limit of practical production tooling available to form this groove and not because this width was preferred from a functional viewpoint.

In tests of this exemplary embodiment injection nozzle, upon full opening movement of the closure member 30, the downstream edge 61 of groove 60 did not project below the end surface 54 of the spray tip 12. Thus static tests of this same injection nozzle, both without a groove 60 and then with a groove 60 on the closure member 30, as described hereinabove, showed substantially similar characteristics for flow versus valve travel and in their spray patterns of the fuel being discharged therefrom. That is, the use of a groove 60, located as described, in the closure member did not appear to degrade the spray pattern of fuel being discharged from the injection nozzle as compared to the operation of an identical nozzle but wih an ungrooved closure member 30 therein.

It is believed that the groove 60 thus provided in the closure member 30 of the above-described exemplary embodiment injection nozzle constructed in accordance with the invention is operative to substantially eliminate carbon build-up inside the discharge end of the injection nozzle in view of the fact that during discharge of fuel, this groove effects turbulent flow of the fuel being discharged to cause carbon deposits that may be present to be washed away and, also in view of the fact that this groove defines an insulating gap which is operative as a thermal barrier.

This latter function of the groove 60 appears to be verifiable because, upon visual inspection of such injection nozzles after extended operation in diesel engines, the metal of the pintle cone 52 upstream or above the groove 60, with reference to the Figures, was found to be as clean and bright as that of an original closure member. This would clearly indicate that the upper portion of the pintle cone 52 was not subjected to the same temperatures as the portions of the pintle below this groove during engine operation. Thus the groove 60, or more clearly the gap or space between the side walls defining the groove is operative as a thermal barrier.

Accordingly, it is not deemed necessary to define specific upper and lower limits for the width and diameter dimensions of the groove 60 since it will now be apparent to those skilled in the art that for the groove 60 to effectively act as a thermal barrier, this groove should preferably be formed as narrow and as deep as practical for a particular application so as to have it define a relatively narrow and deep insulating gap between adjacent metal portions of the pintle 50 and also to provide for as small as sac volume for fuel as possible.

Although in the embodiment shown, the groove 60 is illustrated as having parallel spaced apart side walls and an arcuate bottom surface, it will be apparent to those skilled in the art that the groove can be of other suitable configurations, as for example, it can be a straight walled groove with a flat bottom or it can be of V-shape.

The embodiments of the invention in which an exclusive property or privilege is claimed are defined as follows:

1. In a fuel injection nozzle of the outward opening poppet valve type for a diesel engine, the injection nozzle having a spray tip housing with an axial bore therethrough defining a cylindrical straight walled outlet opening extending a predetermined axial distance from one end thereof to an annular valve seat and a valve member axially movable in the bore, the valve member having an annular seating surface for engagement with the valve seat with a spray control pintle integrally extending therefrom and coacting with the wall of the bore to define a discharge orifice of annulus configuration, the pintle including a straight pintle land portion at its free end and a control cone tapering inwardly from the pintle land to join said seating surface, said pintle land portion having an outside diameter so as to define with said straight walled outlet opening an annular spray discharge orifice; the improvement wherein said valve member further includes a recessed annular groove located on said pintle cone from said free end a preselected distance greater than the axial extent of travel of said valve member so that during full opening movement of the valve member, said groove will not project outboard of said spray tip housing to thus affect the spray discharge pattern while said groove is operative so as to provide a thermal boundry downstream, in terms of fuel flow through the injector, of the seating surface of the poppet valve and, it is operative to effect turbulence of the fuel being discharged when the poppet valve is in an open position relative to the valve, said groove thus being operative so as to substantially eliminate carbon build-up inside the injector during its operation in an engine.

2. In a fuel injector of the outward opening poppet valve type having a spray tip housing with an axial bore therethrough defining at a discharge end thereof a cylindrical straight walled outlet opening extending from the discharge end to an annular valve seat and, a valve member which is axially reciprocable in the bore, the valve member including a valve head with an annular seating surface adapted for seating engagement with the valve seat and a spray control pintle extending from the valve head to coact with the bore wall to define an annular discharge orifice, said spray control pintle including a control cone tapering outward from said annular seating surface to terminate at a narrow pintle land of a uniform external diameter to form with said straight walled outlet opening a spray discharge orifice the free end surface of the pintle being substantially flush with the discharge end when the seating surface engages the valve seat; the improvement wherein said valve member further includes a recessed annular groove of preselected depth and of reduced width so as to provide for a minimum sac-volume, said groove being located on said control cone a predetermined distance from the free end of said spray control pintle greater than the axial extent of reciprocable movement of said valve member so that during opening movement of said valve member said groove will not project outboard of said spray tip housing whereby said groove is thus operative so as to provide a thermal boundry downstream, in terms of fuel flow through the injector, of the seating surface of the valve member and, it is also operative to effect tubulent flow of the fuel when the valve member is in an open position relative to the valve seat whereby said groove is operative so as to substantially eliminate carbon build-up inside the fuel injector.

* * * * *